US005660308A

United States Patent [19]

Bert

[11] Patent Number: 5,660,308

[45] Date of Patent: Aug. 26, 1997

[54] CONNECTOR FOR EXPANSIBLE WATCHBAND SECTIONS

[75] Inventor: Stephen F. Bert, North Scituate, R.I.

[73] Assignee: Textron, Inc., Providence, R.I.

[21] Appl. No.: 656,804

[22] Filed: May 31, 1996

[51] Int. Cl.[6] ..... A44C 5/04

[52] U.S. Cl. ..... 224/175; 224/164; 24/265 WS

[58] Field of Search ..... 224/164, 175, 224/179; 24/265 WS; 368/281, 282; 63/3, 5.1, 5.2; 59/79.1, 79.3

[56] References Cited

U.S. PATENT DOCUMENTS

| | | | |
|---|---|---|---|
| 1,532,334 | 4/1925 | Nelson | 224/175 |
| 3,347,038 | 10/1967 | Teppert | 59/79.1 |
| 4,837,901 | 6/1989 | Bert | 224/164 |
| 4,949,433 | 8/1990 | Bert | 24/265 WS |
| 4,987,655 | 1/1991 | Bert | 24/265 WS |
| 5,090,094 | 2/1992 | Bert | 24/265 WS |

FOREIGN PATENT DOCUMENTS

| | | | |
|---|---|---|---|
| 570638A1 | 11/1993 | European Pat. Off. | 63/5.1 |
| 1363230 | 5/1964 | France | 59/79.1 |
| 1021611 | 12/1957 | Germany | 224/175 |

*Primary Examiner*—Henry J. Recla
*Assistant Examiner*—Gregory M. Vidovich
*Attorney, Agent, or Firm*—Samuels, Gauthier, Stevens & Reppert

[57] ABSTRACT

A connector is disclosed for joining two sections of an expansible watchband. The watchband sections have adjacent ends defined by endmost top and bottom links interconnected by pairs of mutually spaced staples. The connector comprises a unitary element having first and second sets of locking ears projecting laterally in opposite directions from opposite sides thereof. The connector has an initial laterally contracted configuration which accommodates its insertion between the endmost top and bottom links of the adjacent ends of the watchband sections, with the first and second sets of locking ears having passed between and beyond the respective pairs of staples interconnecting the endmost top and bottom links. The thus inserted connector is permanently deformable into a laterally expanded configuration which causes its locking ears to mechanically interengage with the staples to thereby effect a connection between the watchband sections.

7 Claims, 2 Drawing Sheets

CONNECTOR FOR EXPANSIBLE WATCHBAND SECTIONS

BACKGROUND OF THE INVENTION

1. Field of the Invention

This invention relates to watch bands, and is concerned in particular with a connector for joining adjacent ends of longitudinally aligned expansible watch band sections.

2. Description of the Prior Art

The conventional expansible watch band typically includes a row of box-like top links overlying a row of box-like bottom links, with the links of one row being staggered in relation to those of the other row. The top and bottom links are interconnected by pairs of U-shaped staples, with the staples of each pair being located along opposite edges respectively of the band in a mutually confronting relationship. The staples have legs which protrude inwardly into the ends of the links to cooperate with internal springs in providing a means of accommodating longitudinal expansion and contraction of the band.

Typically, the top links are covered with ornamental top shells. The top shells may be metallic stampings of varying decorative designs, or they may be molded from plastic or other non-metallic materials.

It may be desirable to combine watchband sections having different top shell designs into a single assembly. One or more sections might have metallic top shells, and other sections might have plastic top shells. Alternatively all sections might have either all plastic or all metallic top shells, with the top shells of one or more sections having decorative designs which differ from those of other sections.

SUMMARY OF THE INVENTION

The present invention is directed to a connector for joining the adjacent ends of watchband sections having different top shells.

In a preferred embodiment of the invention to be described hereinafter in greater detail, the connector comprises a unitary element having first and second sets of locking ears projecting laterally in opposite directions from its opposite sides. The connector has an initial laterally contracted configuration which accommodates its insertion between the endmost top and bottom links of the adjacent ends of two watchband sections. The lateral spacing between the locking ears of each set is such that the ears can be passed between and beyond the pairs of staples interconnecting the endmost top and bottom links. The thus inserted connector is then permanently deformable into a laterally expanded configuration which causes each set of locking ears to mechanically engage with a respective pair of staples, thereby joining the two sections together.

Other features and attendant advantages of the present invention will become more apparent as the description proceeds with reference to the accompanying drawings, wherein:

DETAILED DESCRIPTION OF THE ILLUSTRATED EMBODIMENTS

Figure 1:
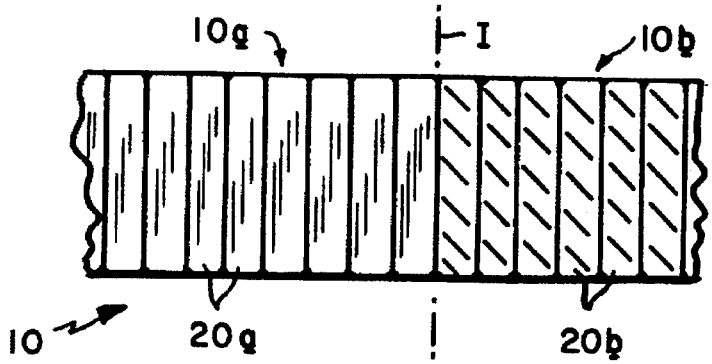
FIG. 1 is a partial top plan view of two expansible watchband sections joined together by means of a connector in accordance with the present invention.
Figure 2:
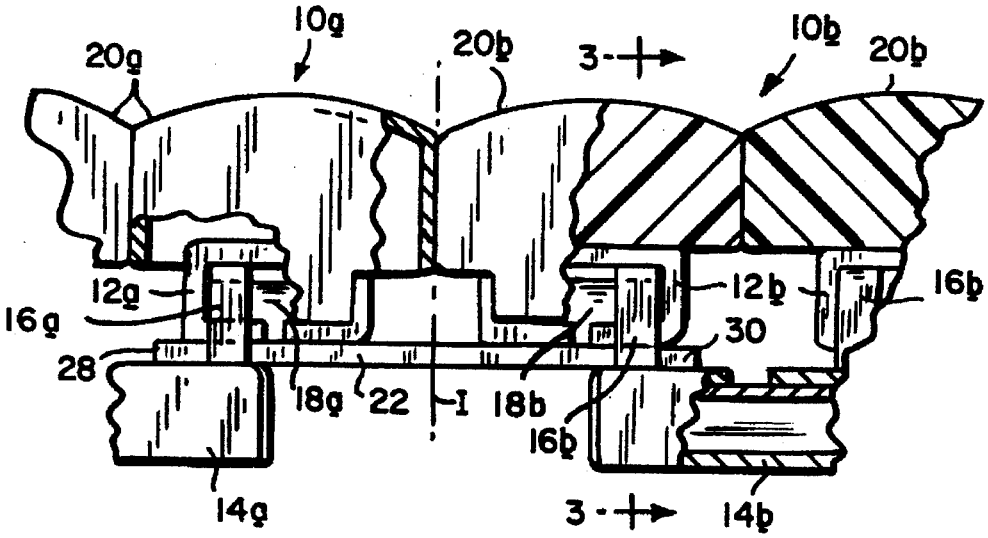
FIG. 2 is a greatly enlarged partial side view, with portions broken away.
Figure 3:
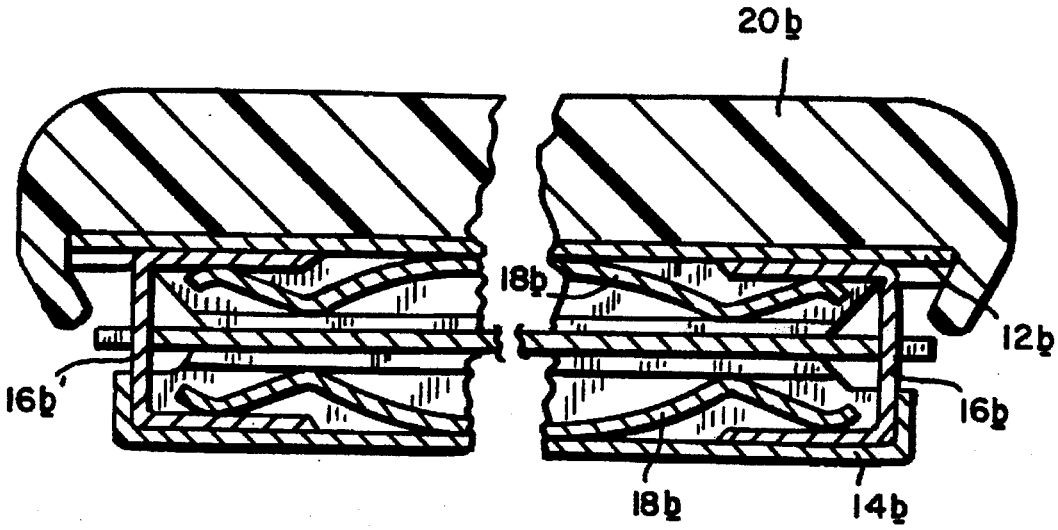
FIG. 3 is a cross sectional view taken along line 3—3 of FIG. 2.

Referring initially to FIGS. 1–3, sections 10*a*, 10*b* of an expansible watchband 10 are shown joined end-to-end at common interface "T". Each watchband section is provided respectively with a row of box-like top links 12*a*, 12*b* overlying a row of box-like bottom links 14*a*, 14*b*. The top and bottom links are staggered in relation to each other in the direction of the band length, and are interconnected by pairs of U-shaped staples 16*a*, 16*a*', 16*b*, 16*b*'. The staples of each pair are located along opposite edges of the band, with legs received in opposite ends of the links connected thereby. The staple legs coact in a known manner with internal springs 18*a*, 18*b* to accommodate resilient longitudinal expansion and contraction of the band 10. The top links 12*a*, 12*b* are covered by decorative top shells 20*a*, 20*b*. In the embodiment disclosed in FIGS. 1–3, the top shells 20*a* comprise metallic stampings, whereas the top shells 20*b* are molded of a plastic material.

Figure 4A:
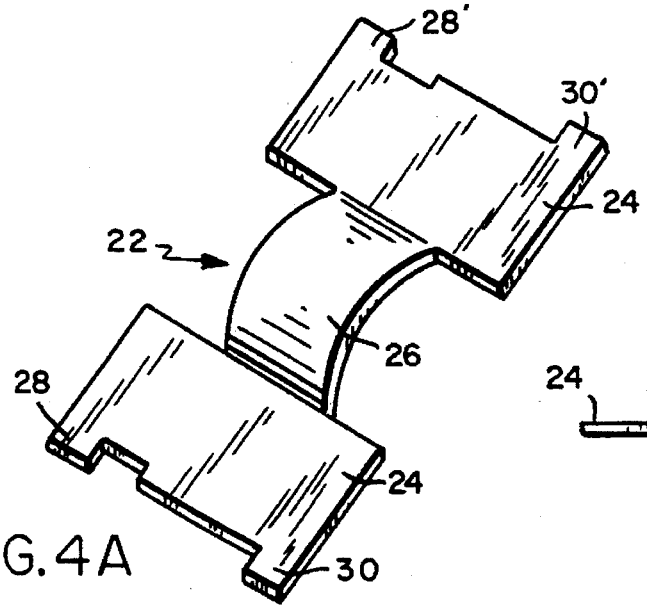
FIG. 4A is a perspective view of a connector in accordance with the present invention, shown in its laterally contracted state prior to being inserted into the adjacent ends of two watchband sections.
Figure 4B:
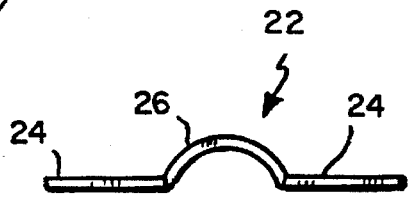
FIG. 4B is an end view on a reduced scale of the connector shown in FIG. 4A.

With reference to FIGS. 4A and 4B, one embodiment of a connector in accordance with the present invention is generally depicted at 22. Connector 22 is a unitary metallic element having coplanar flat side sections 24 joined by a multi dimensionally shaped intermediate section 26. First and second pairs of locking ears 28, 28' and 30, 30' project laterally in opposite directions from the opposite sides of the connector 22.

Figure 5:
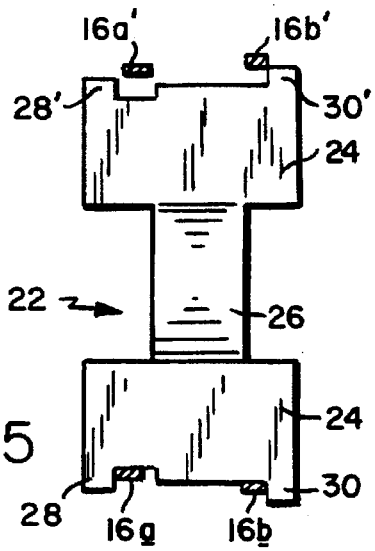
FIG. 5 is a somewhat schematic view showing the relationship of the connector to the staples of two adjacent watchband end sections, after insertion of the connector into the ends of the watchband sections and prior to lateral expansion of the connector, and with the lateral spacing between one pair of staples being different from that of the other pair of staples.

When the connector is in the initial laterally contracted state shown in FIGS. 4A and 4B, and as can be best seen by additional reference to FIG. 5, the lateral spacing between the locking ears 28, 28' and 30, 30' of each set is such that the connector can be manipulated in the plane of its side sections while being inserted between the endmost top and bottom links 12*a*, 14*a* and 12*b*, 14*b* of each watchband section 10*a*, 10*b*. As the connector is thusly inserted, the locking ears 30, 30' pass between and beyond the staples 16*b* and the locking ears 28, 28' likewise pass between and beyond the staples 16*a*. One locking ear 28, 30 of each set is interlocked with one staple 16*a*, 16*b* of each pair with the other locking ear 28', 30' of each set being disengaged from its respective staple 16*a*', 16*b*'.

Figure 6:
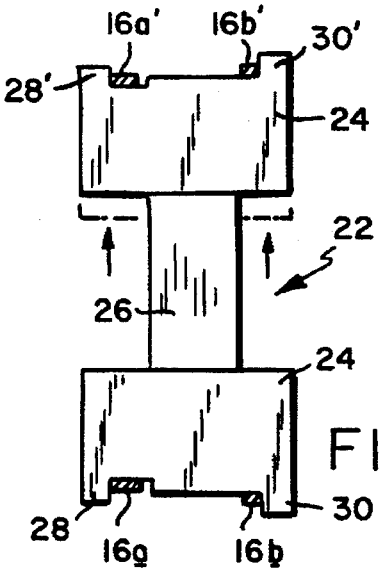
FIG. 6 is a view similar to FIG. 5 showing the connector laterally expanded into an interlocked relationship with the staples.

The intermediate section 26 of the connector is then permanently deformed by being flattened into the plane of the side sections 24. As shown in FIG. 6, the resulting lateral expansion of the connector causes the locking ears 28', 30' to mechanically interengage with their respective staples

16*a'*, 16*b'* to thereby effect a connection between the watchband sections 10*a*, 10*b*.

Figure 7:
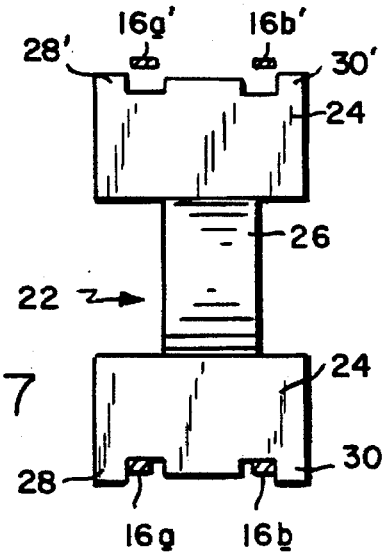
FIGS. 7 and 8 are views similar to FIGS. 5 and 6, with the locking ears of the connector being configured differently to accommodate identically spaced staple pairs.
Figure 8:
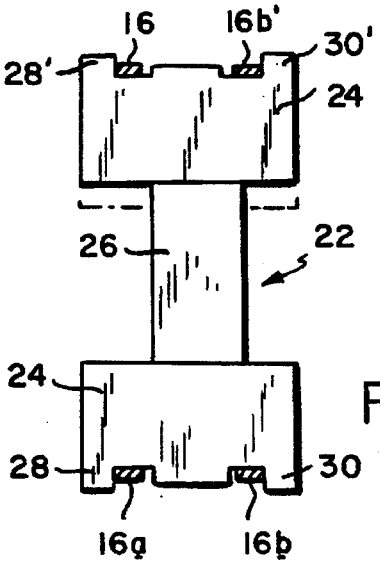

In the embodiment shown in FIGS. 5 and 6, the spacing between staples 16*a*, 16*a'* is different from the spacing between staples 16*b*, 16*b'*, the reason being that differently sized linkages are required to accommodate the metallic and plastic top shells 20*a*, 20*b*.

Where the same type of top shell is being employed in both watchband sections, the sides of the connector 22 can be configured to interact with staple pairs having the same spacing therebetween, as shown in FIGS. 7 and 8.

The intermediate section 26 is preferably arcuately shaped, although other two dimensional shapes are possible, including for example flat sided or peaked configurations. Preferably, the intermediate section is reduced in width as compared to the widths of the side sections 24.

In light of the foregoing, it will now be appreciated by those skilled in the art that the connector of the present invention comprises a low cost unitary metallic component which can be readily inserted into the adjacent ends of two expansible watchband sections, and then conveniently deformed into an interlocked relationship which securely and reliably joins the two watchband sections together.

I claim:

1. A connector for joining two sections of an expansible watchband, said watchband sections having adjacent ends each defined by endmost top and bottom links interconnected by pairs of mutually spaced staples, said connector comprising:

a unitary element having first and second sets of locking ears projecting laterally in opposite directions from opposite sides thereof, said connector having an initial laterally contracted configuration which accommodates its insertion between the endmost top and bottom links of the adjacent ends of said watchband sections, with said first and second sets of locking ears having passed between and beyond the respective pairs of staples interconnecting said endmost top and bottom links, the thus inserted connector being permanently deformable into a laterally expanded configuration which causes said locking ears to mechanically interengage with said staples to thereby effect a connection between said watch band sections.

2. The connector of claim 1 wherein said unitary element has coplanar side sections joined by a multi-dimensionally shaped intermediate section, and wherein said sets of locking ears project laterally and oppositely from said side sections.

3. The connector of claim 2 wherein said intermediate section is arcuately shaped.

4. The connector as claimed in either of claims 2 or 3 wherein said intermediate section is reduced in width as compared to the widths of said side sections.

5. The connector as claimed in any one of claims 2 or 3 wherein said intermediate section is permanently deformable into a coplanar relationship with said side sections.

6. The connector as claimed in claim 1 wherein the staples of each of said pairs are spaced apart by the same distance, and wherein said unitary element has two sets of locking ears with the same laterally contracted dimensions, each set of locking ears being arranged to coact in mechanical interengagement with either of said pairs of staples.

7. The connector as claimed in claim 1 wherein the staples of one of said pairs are spaced apart by a distance which is different from the distance by which the other pair of staples is spaced apart, and wherein said unitary element has two sets of locking ears with different laterally contracted dimensions, each set of locking ears being arranged to coact with one but not the other of said pairs of staples.

* * * * *